United States Patent [19]

Gentaz et al.

[11] 4,105,440

[45] Aug. 8, 1978

[54] PROCESS FOR REDUCING METAL HALIDES BY REACTION WITH CALCIUM CARBIDE

[75] Inventors: Claude Gentaz, Grand-Lancy, Switzerland; Gérard Bienvenu, Annemasse, France

[73] Assignee: Battelle Memorial Institute, Carouge, Switzerland

[21] Appl. No.: 429,704

[22] Filed: Jan. 2, 1974

Related U.S. Application Data

[63] Continuation-in-part of Ser. No. 69,719, Sep. 4, 1970, abandoned.

[30] Foreign Application Priority Data

Sep. 5, 1969 [CH] Switzerland ..... 13482/69
Aug. 7, 1970 [CH] Switzerland ..... 11907/70

[51] Int. Cl.[2] ..... C22B 27/00

[52] U.S. Cl. ..... 75/66; 75/28; 75/67 R; 75/72; 75/84.5

[58] Field of Search ..... 75/66, 77, 84.5, 28, 75/67, 72

[56] References Cited

U.S. PATENT DOCUMENTS

| | | | |
|---|---|---|---|
| 1,319,148 | 10/1919 | Freeman | 75/66 |
| 1,388,086 | 8/1921 | Ashcroft | 75/67 |
| 2,814,561 | 11/1957 | Erasmus | 75/84.5 |
| 3,152,885 | 10/1964 | Raney | 75/84.5 X |

OTHER PUBLICATIONS

Bureau of Mines RI 4059 Mar. 1947 pp. 1–8.

*Primary Examiner*—M. J. Andrews
*Attorney, Agent, or Firm*—Karl F. Ross

[57] ABSTRACT

A metal halide is reduced by reacting it with calcium carbide in a bath in which the calcium carbide is dissolved in a mixture of a halide of at least one alkali metal, specifically sodium, potassium, rubidium and/or cesium, with a halide of at least one alkaline-earth metal, specifically calcium, strontium and/or barium. The desired metal may be one of the aforementioned alkali or alkaline-earth metals, e.g. sodium or magnesium, in which case its halide is one of the constituents of the mixture. Otherwise, a vapor of a halide of the desired metal (e.g. titanium tetrachloride) is bubbled through the bath in order to react with the calcium carbide.

3 Claims, 4 Drawing Figures

PROCESS FOR REDUCING METAL HALIDES BY REACTION WITH CALCIUM CARBIDE

CROSS-REFERENCE TO RELATED APPLICATION

This application is a continuation-in-part of our copending application Ser. No. 69,719 filed Sep. 4, 1970 and now abandoned.

FIELD OF THE INVENTION

Our present invention relates to a process for producing a metal by reduction of at least one of its halides with calcium carbide.

BACKGROUND OF THE INVENTION

It is known that the metallic halides, in particular the halides of alkali metals or alkaline-earth metals, can be reduced with calcium carbide, thereby freeing the metal and carbon, according to the reaction:

$$aMX_n + bCaC_2 \rightarrow aM + 2bC + bCaX_2,$$

wherein M is a metal with a valence of $n$, X is a halogen atom, and the stoichiometric proportions are such that $b/a = n/2$.

In the known processes this reduction is carried out in a heterogeneous — solid-solid, solid-liquid, or solid-gas — medium. Such a process is difficult to perform continuously, which is necessary if one hopes to sell the product at a competitive price. That is probably the reason why up to the present, as far as we are aware, there has been no industrial application of this reaction.

U.S. Pat. No. 3,031,413, to Barber et al., teaches the reduction of a metal halide such as lead chloride by reacting it with a solution of calcium carbide in one or more substantially anhydrous, molten halides, specifically the halides of lithium, calcium, strontium and/or barium.

OBJECTS OF THE INVENTION

The principal object of our invention is to provide an improved process of this general character.

A more particular object is to provide a process allowing the reaction to be carried out in a homogeneous or nearly homogeneous medium, i.e. in a bath which is all liquid or has a gas or a powder dispersed therein, thereby making continuous production possible.

A further object is to provide a process for the purpose set forth which yields substantially pure graphite as a by-product.

SUMMARY OF THE INVENTION

According to the present invention, a desired metal is produced by reducing a halide thereof in a bath consisting essentially of calcium carbide entirely dissolved in a molten mixture of two or more halides, i.e. at least one first halide of sodium, potassium, rubidium or cesium and at least one second halide of calcium, strontium or barium.

If the desired metal is either an alkali metal (in Group I of the Periodic Table) or an alkaline-earth metal (in Group II), its halide may be one of those which are mixed together to form the solvent bath for the calcium carbide; naturally, this particular halide will have to be the least stable one at the selected operating temperature and pressure among the several constituent halides of the mixture. With other metals, especially those in Groups IV, V, VI and VIII of the Periodic Table, their halides may be vaporized and bubbled through the aforedescribed solution in order to react with the calcium carbide dissolved therein.

Though our invention is applicable to halides in general, fluorides and chlorides are preferred.

By this process we obtain metals in an elemental, i.e. uncombined, state even in the case of elements which form stable carbides, such as the following metals: titanium, zirconium, hafnium, tantalum, tungsten, vanadium and niobium.

The process according to the invention facilitates the reduction of volatile metals, such as alkali metals (in particular sodium), and of nonvolatile metals such as those listed above as well as uranium, copper and iron.

In the case of the volatile metals the halide to be reduced can be the same as one of the halides employed as a solvent for the calcium carbide. In this case, when the process is carried out continuously, the halide can be fed into the solution to maintain the quantity of this compound at the level necessary to keep the calcium carbide in solution.

In the case of nonvolatile metals, the halide either can be dissolved in the calcium carbide solution or, if the halide is easy to vaporize, can be passed in vapor form through the solution to dissolve it or at least to let it come into the most intimate contact possible with the solution. To this end the gas stream is preferably injected in the form of tiny bubbles into the calcium carbide solution.

A particularly useful solvent is, for instance, a mixture of sodium chloride and calcium chloride containing from 10 to 25% by weight of sodium chloride.

For the recovery of sodium from sodium chloride, we prefer to dissolve calcium carbide in a molten mixture of a sodium chloride and calcium chloride maintained at a temperature of about 800° to 1200° C, under a pressure of substantially $10^{-4}$ to $10^{-2}$ atmosphere.

Metallic magnesium may be extracted from a molten bath containing calcium carbide dissolved in a mixture of sodium chloride and calcium chloride with the addition of a magnesium halide, preferably magnesium chloride. In the latter case we prefer to dissolve the magnesium chloride in a mixture of sodium and calcium chlorides before, while or after dissolving the calcium carbide therein. The solution should be maintained at a temperature in the range of about 700° to 1200° C, under a pressure of substantially $10^{-2}$ to 1 atmosphere.

The quantity of calcium carbide which can be dissolved in the molten mixtures is generally around 4 to 12% by weight and depends on the nature of the mixture. For example, in the case of a eutectic mixture of sodium and calcium chlorides (i.e. a mixture containing a molar fraction of sodium chloride equal to 0.4), the solubility of the calcium carbide is 7.5% by weight with a temperature between 900° and 950° C. In a mixture of chlorides containing a molar fraction of sodium chloride equal to 0.1, this solubility is 6% by weight.

The calcium carbide is probably dissociated into its ions in the solution, as is apparent from the increase in electrical conductivity by a factor of 1.5 to 3 with respect to a bath of the same composition but lacking the calcium carbide.

In the case of the production of volatile metals it is advantageous, in order to increase the reaction speed and to obtain a purer product to carry out the reduction under subatmospheric total pressure as noted above with reference to sodium and magnesium. With atmospheric total pressure we prefer to operate under the protection of at least one inert gas, e.g. argon.

In certain cases it is desirable to agitate the calcium carbide solution during reduction; this applies particularly to the production of sodium. According to the nature of the metal, it is recovered as a liquid (possibly upon condensation of its vapors) or as a solid. In this latter case the metal is obtained as a powder which is separated by decantation of the reaction mixture.

In the case of the production of magnesium by the reduction of its chloride, it is desirable to minimize the magnesium chloride losses resulting from the reaction between this salt and any lime present in the calcium carbide used.

It is important to note that the process according to the invention makes it possible to obtain, in addition to the desired metal, carbon in the form of very finely divided graphite. Graphite is well known to be an extremely important industrial material. As the calcium carbide used to carry out the process can be produced by reacting calcium oxide with carbon (e.g. anthracite or coke) at a high temperature, the process according to the invention can constitute the second step in the manufacture of graphite from carbon products of very low value, the first step being the production of calcium carbide from these carbon products by a process known per se.

In order to carry out the reduction, different equipment must be used depending on whether the metal to be prepared is volatile or nonvolatile. In the first case the plant includes means for condensing the metallic vapors by extracting them either as a liquid or as a solid and means for separating them from the other condensed substances. In the second case the plant comprises a reactor with a heat exchanger and is equipped with a decantation vat for the solid metal. Anhydrous calcium halides, in particular calcium chloride $CaCl_2$, and very fine and pure carbon are obtained as by-products.

In sodium production a certain quantity of sodium chloride is volatilized. The apparatus used should therefore include means for condensing and recycling the sodium chloride. To this end one can condense first the sodium chloride to a solid and then the sodium to a liquid; alternatively, one can simultaneously condense the sodium and the sodium chloride with a stream of liquid sodium at a temperature low enough to draw off the sodium chloride as a solid, and then either separate the sodium chloride by filtering or reheat the mixture of sodium chloride and sodium to melt the sodium chloride and finally separate the metallic salt by hot decantation.

It is also possible to condense as a solid all the vapors coming from the reactor, i.e. the mixture of the vapors of sodium and of sodium chloride, and then to separate the sodium chloride by distillation under a partial vacuum after having reheated the mixture and decanted most of the liquid sodium thus obtained.

BRIEF DESCRIPTION OF THE DRAWING

The above and other features of our invention will now be described in greater detail with reference to the accompanying drawing in which.

DESCRIPTION OF PREFERRED EMBODIMENTS

The detailed description which follows and the data concerning dimensions, temperatures and pressures, given in conjunction therewith, relate particularly to the production of sodium. However, the same system could be used (with minor changes in dimensions and operating conditions) for the production of the following other volatile metals: potassium, rubidium, cesium, calcium, strontium, barium and magnesium.

Figures 1, 2:
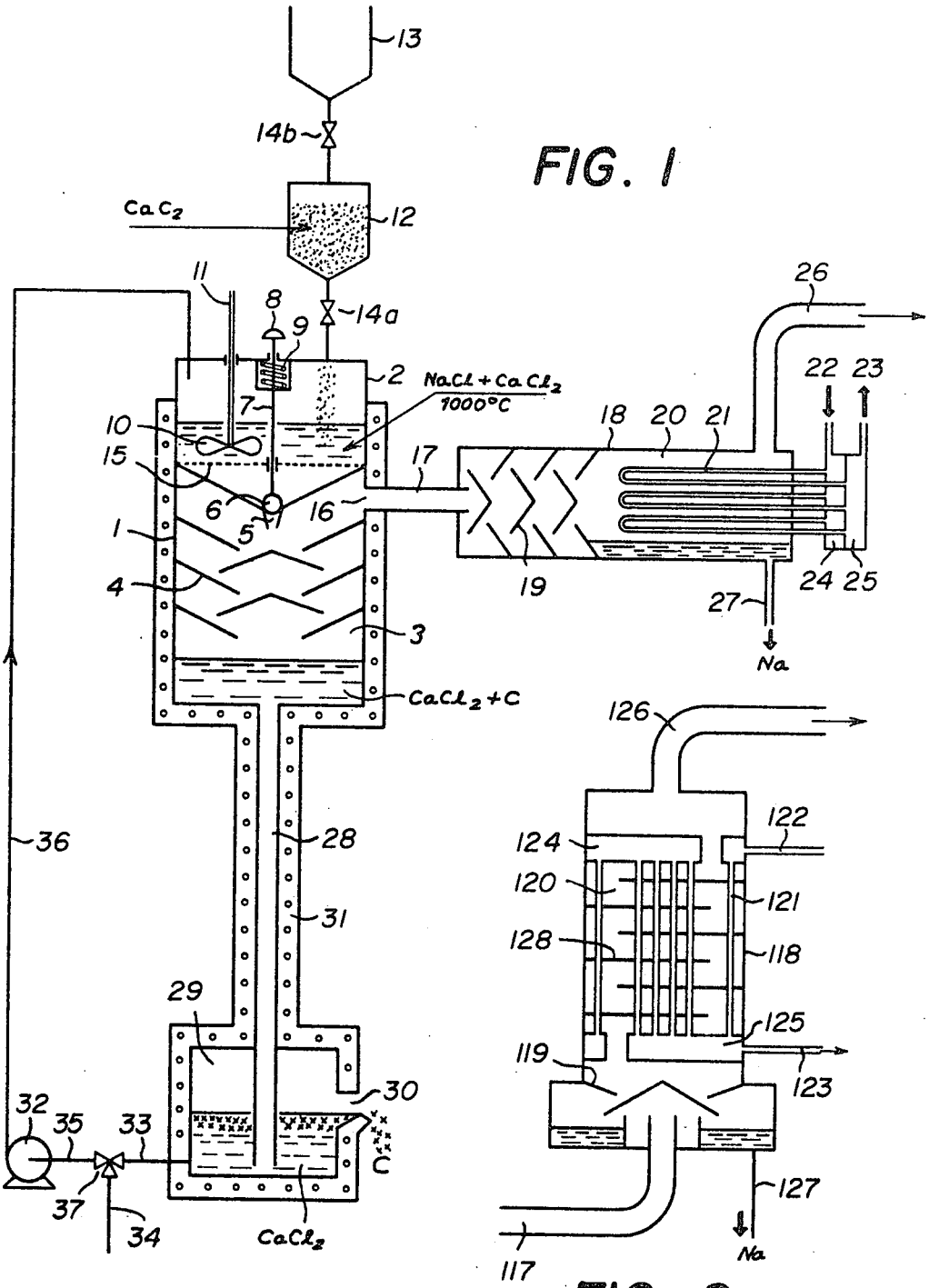
FIG. 1 is a vertical section through a plant for carrying out the process according to our invention by one mode of operation.
FIG. 2 is a vertical section through a modified condenser for the system of FIG. 1.

The installation shown in FIG. 1 comprises a reactor 1 having a mixing vat 2 and a reaction chamber 3. The reaction chamber 3 is provided with deflectors 4. The mixing vat 2 and the reaction chamber 3 communicate with an injection nozzle 5 that can be closed or opened by means of a plug 6 connected by a stem 7 to a control button 8. In its rest position the injection nozzle 5 is closed by the force of a compression spring 9 which biases the plug 6 against the opening of the nozzle 5. The mixing vat 2 is provided with several (e.g. three) agitators, one of which is shown in FIG. 1, each comprising a propeller 10 rotatably driven by a motor (not shown) through a shaft 11. A fluid-tight hopper 12 of the air-lock type, whose interior is permanently kept dry by nonillustrated circulation means constantly renewing the atmosphere therein by exhausting the gases evolving in that hopper and replacing them with a dry gas such as nitrogen, is used to charge the mixing vat 2 with the necessary quantity of calcium carbide and sodium chloride without allowing moisture to enter. An open hopper or funnel 13 serves to feed the airtight hopper 12 with calcium carbide and sodium chloride. Valves **14*a* and 14*b* control the charging of the mixing vat 2 and the hopper 12**, respectively.

The mixing vat 2 is also provided with a sieve screen 15 whose position and mesh size prevent solid particles, such as undissolved granules of calcium carbide having a size greater than, say, 1 mm, from getting into the injection nozzle 5 along with the bath, the latter being a liquid mixture of sodium chloride with calcium chloride recirculated to the vat 2 as described below.

The reaction chamber 3 is provided with an exhaust port 16 to which a vapor-evacuation conduit 17 is connected. The conduit opens into a condenser 18.

The bottom of the reaction chamber 3 is also connected to a barometric column 28 for the withdrawal of the suspension falling to the bottom of the chamber 3, this suspension consisting mostly of fused calcium chloride and carbon in the form of graphite.

A vessel 29, heated to a temperature sufficient to maintain the fused mass in liquid form, serves to separate the graphite by decantation from the suspension. A tap hole 30 disposed at the level of the surface of the dispersion bath during decantation allows the graphite to be drawn off as it comes to that surface.

A heating jacket 31 completely surrounding the mixing vat 2, the reaction chamber 3, the barometric column 28 and the decantation vessel 29 respectively maintains in these different portions of the apparatus the temperature (e.g. 930° C) necessary to dissolve calcium carbide in the mixture of calcium chloride and sodium chloride, the reaction temperature (e.g. 830° C), and a temperature above the solidification temperature of the liquid of the suspension, e.g. between around 750° and 800° C.

A recirculation pump 32 supplied through a conduit 35 allows a portion of the liquid taken from the vessel 29 by a conduit 33 to be recycled via a feedback line 36 into the mixing vat 2, the remainder of the liquid being drawn off from the installation through a conduit 34 connected to the conduit 33 through a three-way valve 37. The pump 32, the conduits 35, 36 and 33, and the valve 37 are also provided with heating means for maintaining their temperature at a level sufficient to prevent solidification of the liquid.

The condenser 18 includes a series of baffles or deflectors 19 in a condensing chamber 20 for sodium provided with tubes 21 cooled by fluid circulation, e.g. by silicone oil. These tubes 21 are generally U-shaped and form a horizontal bank which occupies the central portion of the chamber 20. The tubes 21 are supplied with fluid by means of a feed conduit 22 and a distribution manifold 24. The coolant, after passing through the tubes 21, is drawn off by a collecting manifold 25 and an evacuation conduit 23. The condenser 18 is connected by a conduit 26 to a pumping apparatus (not shown) for establishing and maintaining a subatmospheric pressure, here of $10^{-4}$ to $10^{-2}$ atmosphere, in the condenser 18 and the reaction chamber 4 for the reduction of the sodium chloride at the reaction temperature. A conduit 27 serves to evacuate the condensed sodium as a liquid from the base of the condenser 18.

The installation just described functions as follows:

A mixture of sodium chloride and calcium chloride in proportions corresponding preferably to the eutectic composition of these two salts, i.e. 40 mole % of NaCl and 60 mole % of $CaCl_2$, is introduced into the mixing vat 2 by means of the funnel 13 and the airtight hopper 12. The pressure inside the vat 2 is held equal to or near the atmospheric level. With the plug 6 down in its closed position, the mixture of sodium and calcium chlorides is melted and homogenized by being rapidly agitated by means of the propellers 10. Then calcium carbide is introduced into the vat 2 by means of the hoppers 13 and 12 in quantities just below its dissolution limit while the bath of sodium and calcium chloride remains liquid at, for example, 1000° C. At this temperature the dissolution limit of calcium carbide in the eutectic mixture of sodium chloride and calcium chloride is around 7.5%, by weight.

With the plug 6 now up in its open position, the homogeneous solution prepared as described above is injected into the reaction chamber 3 by the nozzle 5 at a feed rate determined by the size of the pasage left free by the plug. The pressure and temperature in the chamber 3 are held at the values mentioned above.

The reduction of sodium chloride with calcium carbide takes place as the reaction mixture descends in the chamber 3, this descent being slowed by the deflectors 4.

The liquid mass arriving at the bottom of the chamber 3 consists of a suspension of very fine carbon particles in the form of graphite in the melted calcium chloride which contains only very small quantities of sodium chloride and calcium carbide.

The sodium produced by the reaction is in the form of vapor in the chamber 3. This vapor, which also contains a small quantity of vaporized sodium chloride, is drawn off through the conduit 17 and introduced into the condenser 18. The sodium chloride condenses as a solid on the deflectors 19 and the sodium is condensed as a liquid as its vapors impinge against the walls of the tubes 21 which are kept betwen 110° and 120° C by circulation of the coolant therethrough. This liquid sodium is extracted from the condenser 18 at a temperature slightly above 130° C by the conduit 27.

The suspension of carbon in the calcium chloride is drained from the chamber 3 by the barometric column 28 to the vessel 29 where the carbon is separated by decantation. After cooling and washing with water, highly comminuted and very pure carbon in the form of graphite is obtained.

The calcium chloride is partially recycled to the mixing vat 2 and is partially removed from the installation. This latter fraction can be transformed into granules after cooling, a form which facilitates its use in industry.

The plant can be operated discontinuously by introducing successive charges of sodium chloride, calcium chloride and calcium carbide into the vat 2 and by injecting the whoe reaction mixture into the chamber 3 all at once. However, we prefer to operate it continuously by feeding the mixing vat 2 with small charges of sodium chloride and calcium carbide at the rate of consumption of these compounds by the reaction, thus keeping the concentration of the reagents in the mixture constant in the vat 2, and introducing this mixture into chamber 3 either in small fractions or as a constant controlled stream so as to let a certain quantity of the reaction mixture remain at all times in the vat 2.

A plant as shown in FIG. 1 for continuously producing one ton of sodium per hour has, for example, the following characteristics:

| | | | |
|---|---|---|---|
| volume of mixing vat 2 | | $2\ m^3$ | |
| volume of reaction mixture permanently held in this vat | | $1\ m^3$ | |
| flow through injection nozzle 5 with the plug 6 in fully open position | | $6.24\ m^3/h$ | |
| absolute pressure in vat 2 | | about 1 atmosphere | |
| absolute pressure in chamber 3 | | $5 \times 10^{-3}$ atmosphere | |
| temperature in vat 2 | | 1000° C | |
| temperature in chamber 3 | | 930° C | |
| height of barometric column 28 | | 4.7 m | |
| total surface area of thermal exchange of the tubes 21 of the condenser 18 | | $100\ m^2$ | |
| charging rates: | calcium carbide | | 1.39 tons/h |
| | sodium chloride | | 2.54 tons/h |
| | calcium chloride (derived solely from the continuous permanent recycling). | | 9.8 tons/h |

Aside from the ton of sodium, such an installation also produces hourly 0.52 ton of very pure, finely divided graphite and 2.49 tons of calcium chloride.

The condenser 118 shown in FIG. 2 includes elements analogous to those of the condenser of FIG. 1 but is arranged vertically instead of horizontally and its cooling tubes 121 are upright instead of being U-shaped and horizontal as in the condenser of FIG. 1. Condenser 118 is provided with deflectors 119 in a chamber 120 which serves for sodium-vapor condensation and contains the tubes 121 traversed by the aforedescribed cooling fluid. The chamber 120 is also provided with deflectors 128 in the form of interleaved horizontal baffles. The coolant is supplied to the tubes 121 by way of a feed conduit 122 and an inlet manifold 124; after passing through those tubes it is collected in an outlet manifold 125 and exhausted through an evacuation conduit 123. The condenser 118 is connected to a pump system (not shown in FIG. 2) by a conduit 126 and to the reactor 1 by a conduit 117 replacing the conduit 17 of FIG. 1; its operation is the same as that of the condenser 18. The sodium which condenses as a liquid in chamber 120 is drawn off from the bottom of condenser 118 through a conduit 127.

Figures 3, 4:
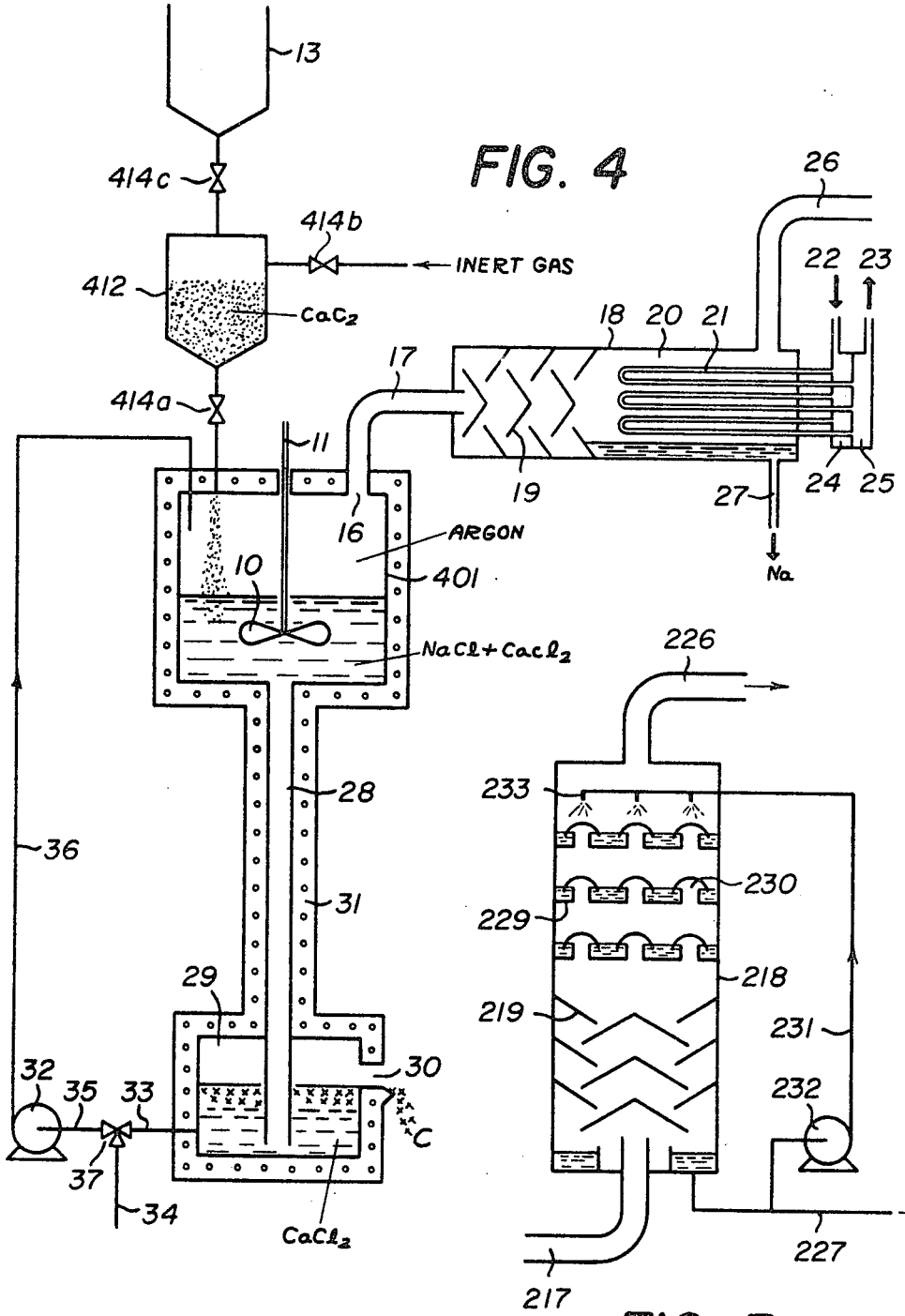
FIG. 3 is a vertical section through another modified condenser.
FIG. 4 is a vertical section through a plant for carrying out the process by another mode of operation.

The condenser 218 shown in FIG. 3 operates by using a portion of the liquid sodium already condensed as the coolant for condensing the incoming sodium vapors. Its condensation chamber, constructed as a distillation column, includes deflectors 219 and a plurality of identical trays 229, here three, provided with identical bubble caps 230. A conduit 227 serves to draw off the liquid sodium which flows to the bottom of the condenser. A portion of the sodium is recycled through a conduit 231 by means of a pump 232 and is injected into the condenser by a plurality of nozzles 233. A conduit 217 serves to connect the condenser 218 to the reactor 1 shown in FIG. 1 and a conduit 226 serves to connect this condenser to a pumping apparatus not shown in FIG. 3. A small quantity of vaporized sodium chloride, entrained by the sodium into the condenser, is condensed to a solid on the deflectors 229 and can be easily recovered by being scraped off.

The installation shown in FIG. 4 includes a reaction chamber 401 intended to serve as a common vessel for the fusion of the mixture of sodium chloride and calcium chloride, the dissolving of the calcium carbide in the melt, and the reduction reaction. Chamber 401 is provided with a device 10, similar to that of FIG. 1, for energetically agitating the reaction mixture during all the steps of the process taking place in the apparatus.

An airtight hopper 412, whose interior can be held at reduced pressure with an inert gas by conventional means (not shown) as discussed with reference to hopper 12 of FIG. 1, feeds the chamber 401 through a pair of values **414*a*, 414*b* with calcium carbide, sodium chloride and, if necessary, calcium chloride. The airtight hopper 412 is itself fed by an ordinary hopper 13 similar to the one shown in FIG. 1. The operation of the systems of FIGS. 1 and 4 is analogous except that the reaction chamber 401** is held at ambient pressure under an inert atmosphere, formed for example of argon, during the fusion of the mixture of sodium chloride and calcium chloride and during the dissolving of calcium carbide in this melt, and that it is then subjected to reduced pressure, e.g. of $5 \times 10^{-3}$ atmosphere, to effect the reduction.

The characteristics of an installation conforming to the system of FIG. 4 and having a production capacity of one ton of sodium per hour are the following:

volume of reaction chamber 401: 12 $m^3$
volume of reaction mixture: 6.24 $m^3$
height of barometric column 28: 4.7 m
effective surface area of condenser: 100 $m^2$
total heating power: 2000 kVA The device is operated by charges whose complete treatment takes around one hour and which consist of:

2.54 tons of NaCl,
1.39 tons $CaC_2$, and
9.8 tons $CaCl_2$ (derived from the preceding charge).

After treatment of each charge the yield is one ton of sodium, 2.41 tons of $CaCl_2$ and 0.52 ton of graphite.

SPECIFIC EXAMPLES

EXAMPLE I (Production of Sodium by Continuous Process)

In the reaction chamber 401 of an installation of the type shown in FIG. 4, equipped with helical agitators 10 and maintained at 930° C under an atmosphere of argon initially at ambient pressure, 12.21 tons of calcium chloride is melted with progressive establishment of partial vacuum. The resulting bath has a volume of about 6 $m^3$ in the chamber and fills the barometric column 28, having a height of 4.7 m, on being heated to a temperature above the fusion point of that compound (720° C), here 800° C.

Subsequently a pressure of $5 \times 10^{-3}$ atmosphere is established in the chamber and, with continuing agitation of the bath, 2.54 tons per hour of sodium chloride and 1.39 tons per hour of calcium carbide are introduced in small installments by means of the airtight hopper 412, maintained at approximately the same pressure as the interior of the chamber. This takes place under constant recycling of 9.8 tons per hour of liquid calcium chloride drawn off by the pump 32 and passed through heated conduits 33, 35 and 36 from the decantation vessel 29 at the foot of the barometric column.

The result is thus a continuous reaction in which 1 ton of sodium per hour is recovered from the chamber 401 as a vapor along with removal of 2.41 tons per hour of calcium chloride from the circuit which allows the bath to be maintained at a constant level in the reactor. In vessel 29 a quantity of 0.52 ton per hour of carbon (in the form of highly comminuted graphite) is separated by decantation and filtration.

The sodium vapors, which also carry along traces of sodium chloride vapor, are liquefied in the condenser 18 whose nonillustrated exhaust pump maintains the reduced pressure inside the chamber 401 and this condenser. Then the sodium chloride is solidified by contact of its vapors with the deflectors 19 confronting the inlet port of the condenser. Finally the liquid sodium is separated from the last traces of its chloride in heated decantation vats maintained at a temperature above the fusion point of sodium chloride.

The heating power of the installation which is necessary to obtain one ton of sodium per hour is 2000 kVA.

EXAMPLE II

The same processes as in Example I are carried out but the calcium chloride, instead of being recirculated to the chamber 401 as a liquid, is solidified into granules as it leaves the vessel 29. A portion of this granular salt is recycled at the rate of 9.8 tons per hour to the reaction mixture in the chamber.

EXAMPLE III

The same process as in Example I is carried out in an installation of the type shown in FIG. 1. The liquid mixture is prepared in the vat 2, serving as a crucible, outside the reaction chamber 3 and is maintained at 1000° C under an inert protective gas (dry argon) at atmospheric pressure.

The homogeneous liquid mixture obtained in the crucible 2 is continuously injected in a small stream into the reaction chamber 3 which, contrary to the chamber 401 used for Example I, is not provided with agitation means. Owing to the baffle-type deflectors 4 in that chamber, the liquid coming from the crucible or vat 2 is slowed down in its descent and is spread out in the form of fluid layers having a large free surface, chamber 3 being maintained at 930° C under a pressure of $5 \times 10^{-3}$ atmosphere.

The sodium is condensed and separated from the traces of its chloride as in Example I. Here, again, 9.8 tons per hour of liquid calcium chloride is recycled to the crucible.

EXAMPLE IV (Production of Titanium from its Tetrachloride)

Titanium tetrachloride is fed at 1.5 grams per minute into a stream of hot argon for vaporization thereby, and the gaseous flow thus formed is bubbled through a bath of a eutectic mixture of calcium chloride and sodium chloride (0.4 mole NaCl + 0.6 mole $CaCl_2$) maintained at 560° C in which calcium carbide is dissolved progressively at the rate of 2 grams per minute. The quantity of the eutectic NaCl + $CaCl_2$ mixture is 1000 grams. Before starting to introduce the calcium carbide and the titanium tetrachloride, the bath of the eutectic NaCl + $CaCl_2$ is dehydrated by forming a vacuum over this mixture and then bubbling a stream of chlorine (at a rate of 0.5 liter per minute) through it for 30 minutes. The passage of the gaseous flow is stopped along with the addition of calcium carbide after 68 minutes, after introduction of 102 g of $TiCl_4$ into the bath and dissolution of 136 g of calcium carbide therein.

Large particles of pure titanium are obtained in the form of platelets along with a very fine powder containing around 75% by weight of titanium and 25% by weight of carbon. Also obtained is a very fine graphite powder. The large titanium particles and a little of the finely comminuted titanium and carbon are separated from the graphite. Around 20 g of titanium per hour are thus produced.

EXAMPLE V (Production of Magnesium)

10 kg of a bath of molten salts, having the following composition by weight, is maintained at 730° C under a protective gas of argon at atmospheric pressure:

NaCl: 54%
$CaCl_2$: 23%
$MgCl_2$: 22%
KCl: 1%

To this mixture, which is being energetically agitated, a total quantity of 1.85 kg of calcium carbide is added in small installments at a rate of 116 grams every 15 minutes to form a homogeneous solution. After 4 hours the agitation is stopped and the resulting magnesium is decanted with a purity greater than 99.8%, the yield being about 80–95% of the theoretical maximum.

In the following Table we have summarized the results of additional Examples carried out in the same general manner with a variety of reactants:

| Ex. No. | Bath composition (weight %) | | | | | | | | | | | |
|---|---|---|---|---|---|---|---|---|---|---|---|---|
| | NaF | NaCl | KF | KCl | RbCl | CsCl | $CaF_2$ | $CaCl_2$ | $SrCl_2$ | $SrF_2$ | $BaF_2$ | $BaCl_2$ |
| VI | | | | 20.4 | | | | 60.6 | | | | 19 |
| VII | | | | | | | | 11.4 | 24.5 | | | |
| VIII | | | 21.3 | | | | 57.3 | | | | 21.4 | |
| IX | 16.4 | | | | | | 60.9 | | | | 22.7 | |
| X | | | | 3.5 | 23.7 | | 72.8 | | | | | |
| XI | 5 | | | | | 27.7 | 66.3 | | | | | |
| XII | | 27 | | | | | | | 73 | | | |
| XIII | | 33 | | | | | | | | 67 | | |
| XIV | | 30 | | | | | | | | | 70 | |
| XV | | 16 | | | | | | | | | | 84 |
| XVI | | | 22.5 | | | | | 77.5 | | | | |
| XVII | | | | 18 | | | | 82 | | | | |
| XVIII | | | | | 24 | | | 76 | | | | |
| XIX | | | | | | 28 | | 72 | | | | |
| XX | 45 | | | | | | 55 | | | | | |
| XXI | | 25 | 25 | | | | | 50 | | | | |
| XXII | 5 | 15 | | 20 | | | | 60 | | | | |

| Ex. No. | $CaC_2$ kg per 10 kg. bath | Bath temp. (° C) | Press (atm.) | Metal rcy'd | Product yield (%) |
|---|---|---|---|---|---|
| VI | 1.10 | 700 | $10^{-3}$ | K | 70–90 |
| VII | 1.23 | 850 | $10^{-3}$ | Sr | 60–80 |
| VIII | 1.46 | 1,100 | 1 | K | 80–95 |
| IX | 1.56 | 1,100 | 1 | Na | 80–95 |
| X | 1.87 | 800 | $10^{-2}$ | Rb | 70–95 |
| XI | 0.68 | 750 | 1 | Cs | 80–95 |
| XII | 1.85 | 700 | $10^{-5}$ | Na | 70–85 |
| XIII | 2.3 | 900 | $10^{-3}$ | Na | 85–95 |
| XIV | 2.05 | 930 | $10^{-3}$ | Na | 85–95 |
| XV | 1.1 | 800 | $10^{-4}$ | Na | 80–90 |
| XVI | 1.55 | 900 | $10^{-2}$ | K | 80–95 |
| XVII | 0.97 | 700 | $10^{-3}$ | K | 70–90 |
| XVIII | 0.80 | 900 | $10^{-1}$ | Rb | 80–90 |
| XIX | 0.67 | 900 | 1 | Cs | 85–95 |
| XX | 4.2 | 900 | $10^{-3}$ | Na | 90–95 |
| XXI | 1.72 | 1,100 | 1 | K | 80–95 |
| XXII | 1.07 | 700 | $10^{-3}$ | K | 80–95 |

We claim:

1. A process for obtaining a desired alkali metal, selected from the group which consists of sodium, potassium, rubidium and caesium, from a halide thereof, comprising the steps of:

forming a solvent bath by melting a mixture of said halide of the desired alkali metal and a halide of at least one alkaline-earth metal selected from the group which consists of calcium, strontium and barium;

homogenizing the molten mixture;

dissolving calcium carbide in the homogenized mixture; and reacting the dissolved calcium carbide in said bath with said halide of the desired alkali metal for a period and at a temperature sufficient to bring about a reduction of the last-mentioned halide.

2. A process as defined in claim 1 wherein the desired alkaline metal is sodium, sald mixture consisting essentially of sodium chloride and calcium chloride, the sodium chloride constituting between substantially 10% and 25% by weight of the mixture.

3. A process as defined in claim 2 wherein the reduction of sodium chloride proceeds at a temperature substantially in the range of 800° to 1200° C and under a pressure substantially in the range of $10^{-4}$ to $10^{-2}$ atmosphere.

* * * * *